US005427003A

United States Patent [19]

Boltak et al.

[11] Patent Number: 5,427,003

[45] Date of Patent: Jun. 27, 1995

[54] SCREWDRIVER

[75] Inventors: Boris Boltak, Beaverton, Oreg.; Anthony F. Beugelsdyk; Marvin L. Cox, both of Wichita, Kans.

[73] Assignee: Wescon Products Company, Wichita, Kans.

[21] Appl. No.: 169,034

[22] Filed: Dec. 20, 1993

[51] Int. Cl.[6] ..... B25B 13/00

[52] U.S. Cl. ..... 81/58.3; 81/29; 81/177.4; 81/490

[58] Field of Search ..... 81/29, 58.3, 177.1, 81/177.5, 489, 490, 492

[56] References Cited

U.S. PATENT DOCUMENTS

| | | | |
|---|---|---|---|
| 1,438,227 | 12/1922 | Eisenhard | 81/29 |
| 2,667,801 | 2/1954 | Eaves | 81/58.3 |
| 3,827,470 | 8/1974 | Douglas et al. | 81/29 |
| 3,957,096 | 5/1976 | Rooman | 81/177.1 |
| 4,631,770 | 12/1986 | Goldberg | 81/490 X |
| 4,793,222 | 12/1988 | Beugelsdyk . | |
| 5,305,667 | 4/1994 | Caballero | 81/490 X |

*Primary Examiner*—James G. Smith
*Attorney, Agent, or Firm*—Hovey, Williams, Timmons & Collins

[57] ABSTRACT

A screwdriver includes an elongated shaft including a first engagement surface, and a handle including a second engagement surface opposing the first surface. The handle receives the shaft and allows limited axial movement of the shaft relative to the handle in a direction parallel to the longitudinal axis of the shaft between a rotation transmitting position in which the first and second engagement surfaces are in contact with one another during rotation of the handle and a disengaged position in which the first and second engagement surfaces are out of contact with one another during rotation of the handle. The first and second engagement surfaces mate with one another to prevent relative sliding movement between the surfaces when they are in contact with one another so that the handle and shaft rotate together when the shaft is in the rotation transmitting position. The shaft rotates freely relative to the handle when the shaft is in the disengaged position, and is biased toward the disengaged position.

11 Claims, 1 Drawing Sheet

SCREWDRIVER

BACKGROUND OF THE INVENTION

1. Field of the Invention

The present invention relates generally to screwdrivers and, more particularly, to a screwdriver which provides selective transmission of rotational movement of a tool handle to the driving shaft.

2. Discussion of the Prior Art

A common problem experienced with conventional screwdrivers arises due to the need for repositioning the tool on the screw after each turn of the screwdriver in order to continue threading or unthreading the screw, as desired.

This problem makes it difficult to use the conventional device either when the screw head is not clearly visible, or when the user is in an awkward or off balanced position.

One solution to this problem is to provide a ratcheting screwdriver which allows the handle of the screwdriver to free wheel in one prescribed rotational direction relative to the shaft of the tool so that a constant axial force may be applied to the tool while the handle is rotated repeatedly back and forth, and rotation of the handle is only transmitted to the shaft when the handle turns in a direction opposite the prescribed direction.

Although such tools represent an improvement over conventional screwdrivers, they are expensive and complex, requiring numerous interfitting parts. Because of this added complexity, these tools are uneconomical to produce.

OBJECTS AND SUMMARY OF THE INVENTION

It is an object of the present invention to provide a screwdriver of simple construction which allows the tip of the tool to remain in engagement with the screw during the entire installation of the screw. In addition, while the tool tip engages the screw, the invention permits the tool handle to be rotated relative to the shaft so that a user may rotate the handle in a direction opposite to the driving direction in preparation for subsequent driving action.

It is another object of the present invention to provide a tool having a plurality of tips for different applications, and a means for facilitating storage of the tips on the handle so that the tool and tips are packaged and stored together in a single unit.

In accordance with these and other objects evident from the following description of a preferred embodiment, a screwdriver comprises an elongated shaft defining a central longitudinal axis, and including a first engagement surface, and a handle including a second engagement surface. The handle also includes a mounting means for retaining the shaft on the handle for limited axial movement relative to the handle in a direction parallel to the longitudinal axis between a rotation transmitting position in which the first and second engagement surfaces are in contact with one another during rotation of the handle and a disengaged position in which the first and second engagement surfaces are out of contact with one another during rotation of the handle. The first and second engagement surfaces include a means for preventing relative sliding movement between the surfaces when the surfaces are in contact with one another so that the handle and shaft rotate together when the shaft is in the rotation transmitting position. The mounting means retains the shaft on the handle for free rotational movement of the shaft relative to the handle when the shaft is in the disengaged position, and a biasing means biases the shaft toward the disengaged position.

By constructing a screwdriver in this manner, numerous advantages are achieved. For example, by forming the screwdriver shaft and handle with opposed, mating engagement surfaces that transmit rotation when in contact with one another, a tool results which is of simple design while allowing reliable, reversible operation. Further, the device may be constructed of a size and shape that is easy to handle, even in tight quarters, in order to allow the tool to be used in most situations where a conventional screwdriver could be employed.

Further, by constructing a screwdriver in accordance with the present invention, it is possible to change the direction of engaged rotation without requiring operation of a special switch as in conventional devices. This advantage is useful during initiation of a screwdriving operation since the construction allows the user to repeatedly turn the screwdriver back and forth to drive the screw into the material being penetrated. The construction also allows disengaged relative movement of the screwdriver shaft in both directions such that the user may drive a screw in or out by directly rotating the screwdriver shaft with their fingers.

BRIEF DESCRIPTION OF THE DRAWINGS FIGURES

A preferred embodiment of the present invention is described in detail below with reference to the attached drawing figures, wherein.

DETAILED DESCRIPTION OF THE PREFERRED EMBODIMENT

Figure 1:
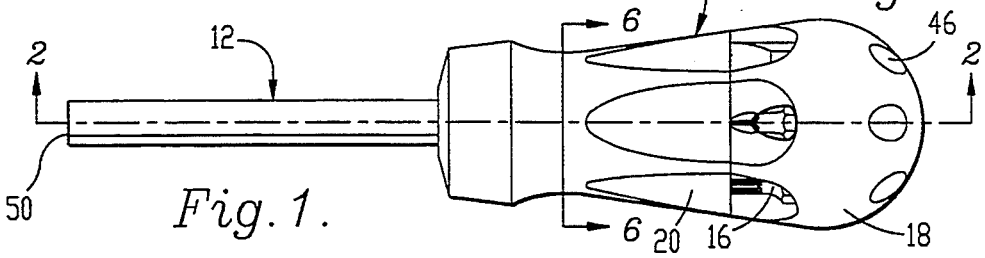
FIG. 1 is a side elevational view of a screwdriver constructed in accordance with the preferred embodiment, illustrating a plurality of tips stored in a handle of the screwdriver.

A screwdriver constructed in accordance with the preferred embodiment is illustrated in FIG. 1, and includes a handle 10, a shaft 12, and a plurality of tips 14, 16.

Figure 3:
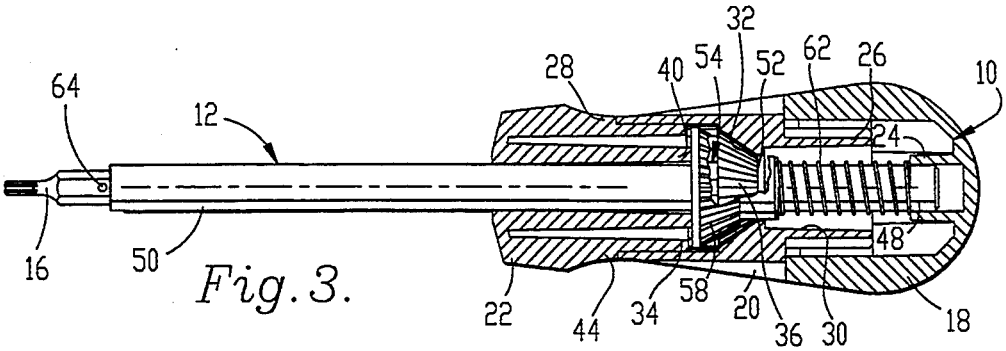
FIG. 3 is a sectional view, partially fragmented, of the screwdriver taken along line 2—2 of FIG. 1, illustrating the shaft in a disengaged position and showing a tip during installation on the shaft.

The handle 10 is shown in further detail in FIG. 3, and includes an end cap 18, an intermediate section 20, and a forward section 22, all formed of plastic or other suitable material. These pieces 18, 20, 22 are either press fitted, welded together during construction or are fixed with an adhesive or the like. The end cap 18 is cup-shaped, having one closed end and an opposed open end sized for receiving an end of the intermediate section 20.

A tubular socket 24 extends from the closed end of the cap toward the open end, and is sized to receive one end of the shaft for guiding axial and rotational movement of the shaft relative to the handle. The outer surface of the end cap is rounded to present a shape easily retained within the palm of a user's hand.

The intermediate section 20 includes a first end 26 received within and secured to the end cap 18, and a second end 28 connected to the forward section. The intermediate section is hollow, including an inner circumferential surface divided into three axial segments 30, 32, 34. The rear segment 30 adjacent end 26 is cylindrical, having a diameter greater than the diameter of the shaft. The forward segment 34 adjacent the second end 28 of the intermediate section is also cylindrical, having a diameter greater than the diameter of the rear segment and receiving the forward section of the handle.

Figure 6:
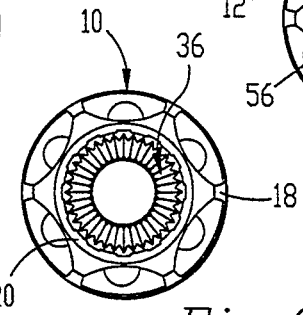
FIG. 6 is a sectional view of the handle taken along line 6—6 of FIG. 1, with the shaft and forward section removed from the screwdriver.

The intermediate segment connects the other segments together, and includes a tapered surface, defining an engagement surface 36. As shown in FIG. 6, the engagement surface is roughened, preferably including a plurality of beveled teeth 38, each extending in a direction along the length of the intermediate section.

Returning to FIG. 3, the forward section 22 includes a first end 40 received within the intermediate section 20 and spaced a short distance from the engagement surface 36 presented by the intermediate section 20. Thus, a space is defined within the handle between the intermediate axial segment 32 of the intermediate section 20 and the end 40 of the forward section 22.

The forward section includes a cylindrical inner circumferential surface 42 having a diameter substantially equal to the diameter of the shaft, and extending along substantially the entire length of the forward section 22. The surface 42 supports the shaft during rotational and axial movement, and is slightly tapered radially outward adjacent the end 40 of the section 22 for convenience during molding and to facilitate assembly of the shaft on the section before the handle pieces 18, 20, 22 are put together.

The outer surface of the forward section is formed with a circumferential step 44 which abuts the end 28 of the intermediate section 20 to position the first end 40 of the forward section properly with respect to the engagement surface 36. In addition, the shape of the forward section is designed to facilitate gripping of the handle.

Figure 4:
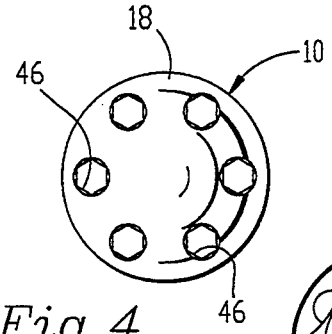
FIG. 4 is a top plan view of the screwdriver.

As shown in FIG. 4, the end cap is formed with six axially extending cavities 46 adapted to receive the tips 14, 16 when not in use with the screwdriver. Each cavity 46 is formed of a polygonal, e.g. hexagonal cross-sectional shape adapted to correspond with the cross-sectional shape of the tips. Returning to FIG. 1, when it is desired to remove one of the tips from its storage position on the handle, the tip is manually pushed from the cavity in which it is stored, and is fitted on the screwdriver in a manner described below.

Figure 7:
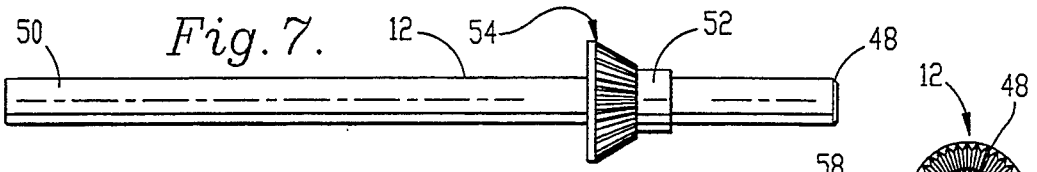
FIG. 7 is a side elevational view of the shaft.
Figure 5:
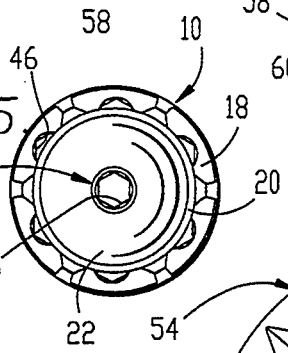
FIG. 5 is a bottom plan view of the screwdriver.

The shaft 12 of the screwdriver is illustrated in FIG. 7, and is of unitary construction including a first end 48, a second end 50 opposed to the first end, a stepped portion 52 intermediate the ends, and a conical portion 54. The shaft 12 is formed of any suitable metal, such as preferably tool steel, but also suitable would be mild steel, brass, aluminum or other material, capable of withstanding the torque typically experienced during the use of the screwdriver. The second end 50 of the shaft is illustrated in FIG. 5, as including a cavity 56 extending axially into the shaft. The cavity has a polygonal cross-sectional shape. In the preferred embodiment, the shape of the cavity is hexagonal. However, it is understood that any other polygonal shape would suffice.

As illustrated in FIG. 3, the stepped portion 52 of the shaft has a diameter substantially equal to the smallest diameter of the intermediate segment 32 of the handle section 20 so that when the shaft is assembled on the handle the stepped portion 52 positions the shaft relative to the intermediate section 20 and guides both axial and rotational movement of the shaft relative to the handle. Returning to FIG. 7, the conical portion 54 of the shaft defines an engagement surface 58 which opposes the engagement surface 36 defined by the intermediate segment of the handle section 20.

Figure 8:
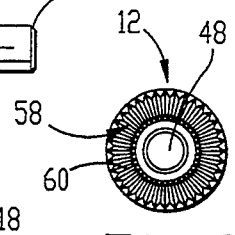
FIG. 8 is a top plan view of the shaft.
Figure 9:
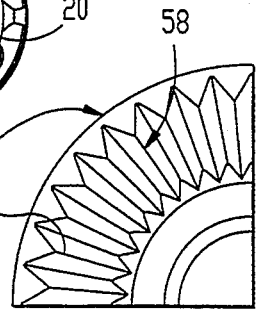
FIG. 9 is a fragmentary exploded view of the shaft.

The engagement surface 58 is illustrated in FIG. 8, and is roughened, including a plurality of beveled teeth 60 sized for engagement with the teeth 38 formed in the handle. As shown in FIG. 9, each tooth 60 on the engagement surface 58 includes a triangular cross-sectional shaped, and extends generally along the shaft so that rotational movement of the handle is transmitted to the shaft when the engagement surfaces are in contact with one another.

Figure 2:
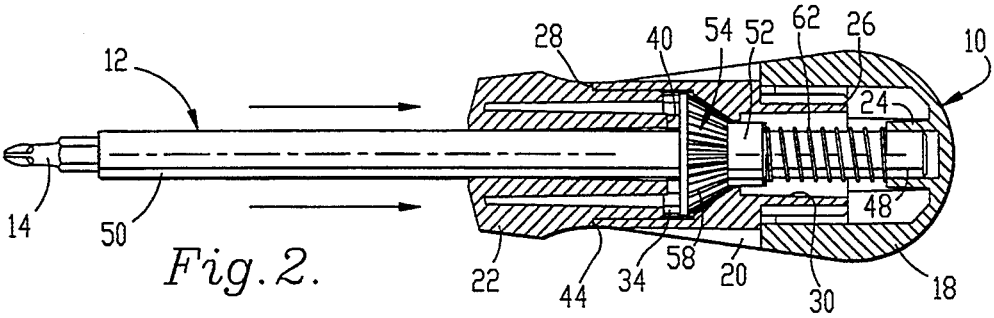
FIG. 2 is a sectional view of the screwdriver taken along line 2—2 of FIG. 1, illustrating the shaft in a rotation transmitting position.

The axial length of the conical portion 54 is less than the combined length of the tapered segment 32 and the space within the handle between the engagement surface 36 and the first end 40 of the forward section. Thus, there is a limited degree of axial movement allowed between the shaft and the handle. This movement is guided by the socket 24, the small diameter end of the tapered segment 32, and the inner circumferential surface 42 of the forward section 22. Thus, the shaft may be moved between a rotation transmitting position, shown in FIG. 2, in which the first and second engagement surfaces 36, 58 are in contact with one another during rotation of the handle and a disengaged position, shown in FIG. 3, in which the first and second engagement surfaces are out of contact with one another during rotation of the handle.

A biasing means is provided between the handle and the shaft for biasing the shaft toward the disengaged position, as shown in FIG. 3. Preferably, this means includes a compression spring 62 having one end seated against the socket and the opposite end seated against the stepped portion of the shaft. This spring 62 urges the shaft 12 away from engagement with the tapered intermediate segment 30 of the handle so that the engagement surfaces 36, 58 are out of contact with one another, and in this position the handle may be freely rotated relative to the shaft.

The tips 14, 16 each preferably include a detent such as a spring-biased, radially protruding ball 64, which engages the side of the cavity 56 to hold the tip in place on the tool during use. Once one of the tips is positioned on the tool, it is placed in contact with a screw to be turned, and the user presses the handle axially toward the screw in order to transmit rotation through the shaft to the screw in a desired direction.

After the user has reached the limit of his rotational reach, axial pressure on the handle is relaxed so that the spring 62 moves the handle away from the rotation transmitting position while maintaining the shaft and tip in contact with the screw. Thereafter, the handle is rotated back to the initial position, and axial pressure is again exerted so that a subsequent driving action may be carried out. This same procedure of using the tool is employed regardless of the direction in which the screw is being turned, except that when reversing the driving direction, the axial pressure is exerted when rotating the handle in the new driving direction.

Although the invention has been described with reference to the preferred embodiment illustrated in the attached drawing figures, it is understood that equivalents may be employed and substitutions made herein without departing from the scope of the invention as recited in the claims.

What is claimed is:

1. A screwdriver comprising:

an elongated shaft defining a central longitudinal axis and including first and second opposed axial ends and a first engagement surface intermediate the ends;

a handle presenting an outer gripping surface and an inner circumferential surface adapted to support the shaft on both sides of the first engagement surface, the inner surface including a socket for receiving the first end of the shaft and guiding the first end of the shaft during relative axial and rotational movement, an inner circumferential surface segment for supporting the shaft at a position between the first engagement surface and the second end of the shaft, and a second engagement surface facing the first engagement surface, the inner circumferential surface of the handle permitting limited axial movement of the shaft relative to the handle in a direction parallel to the longitudinal axis between an engaged position in which the first and second engagement surfaces are in contact with one another during rotation of the handle and a disengaged position in which the first and second engagement surfaces are out of contact with one another during rotation of the handle; and a biasing means for biasing the shaft toward the disengaged position.

2. The screwdriver as recited in claim 1, wherein the biasing means includes a compression spring seated between the handle and the shaft.

3. The screwdriver as recited in claim 1, wherein the first engagement surface is angled relative to the longitudinal axis and the second surface is parallel to the first surface to provide surface contact therebetween.

4. The screwdriver as recited in claim 1, wherein the first and second engagement surfaces are roughened.

5. The screwdriver as recited in claim 1, wherein the first and second engagement surfaces are toothed.

6. The screwdriver as recited in claim 1, wherein the second end of the shaft includes a cavity having a polygonal cross-sectional shape, the screwdriver further comprising a tip having a first end formed of a polygonal cross-sectional shape sized for receipt in the cavity, and a second end formed in a shape adapted to carry out a screwdriving operation.

7. The screwdriver as recited in claim 6, further comprising a plurality of the tips, each provided with a second end having a shape different from the shape of the second ends of the remaining tips.

8. The screwdriver as recited in claim 6, wherein the tip includes detent means for retaining the first end of the tip in the cavity during use.

9. The screwdriver as recited in claim 7, wherein the handle includes a storage means for storing unused tips.

10. The screwdriver as recited in claim 9, wherein each of the tips include detent means for retaining the first end of the tip either in the cavity of the shaft or the storage means of the handle.

11. A screwdriver comprising:

an elongated shaft defining a central longitudinal axis and including first and second opposed axial ends and a first engagement surface intermediate the ends;

a handle presenting an outer gripping surface and an inner circumferential surface adapted to support the shaft on both sides of the first engagement surface, the handle including an end cap having a socket for receiving the first end of the shaft and guiding the first end of the shaft during relative axial and rotational movement, an intermediate section connected to the end cap and having a second engagement surface, and a forward section connected to the intermediate section and including an inner circumferential surface segment for supporting the shaft at a position between the first engagement surface and the second end of the shaft, the end cap, intermediate section and forward section of the handle defining a space in the handle within which the shaft is supported for limited axial movement in a direction parallel to the longitudinal axis between an engaged position in which the first and second engagement surfaces are in contact with one another during rotation of the handle and a disengaged position in which the first and second engagement surfaces are out of contact with one another during rotation of the handle; and a biasing means for biasing the shaft toward the disengaged position.

* * * * *